US008517804B2

(12) United States Patent
Weigmann et al.

(10) Patent No.: US 8,517,804 B2
(45) Date of Patent: Aug. 27, 2013

(54) PRESSING DEVICE FOR CUTTING MEANS AND APPARATUS AND METHOD FOR FINISHING CIRCUMFERENTIAL SURFACES ON CYLINDRICAL PARTS OF A WORKPIECE

(75) Inventors: Uwe-Peter Weigmann, Nurtingen (DE); Marcel Bosch, Nurtingen (DE)

(73) Assignee: Nagel Maschinen- und Werkzeugfabrik GmbH (DE)

( * ) Notice: Subject to any disclaimer, the term of this patent is extended or adjusted under 35 U.S.C. 154(b) by 611 days.

(21) Appl. No.: 12/738,570

(22) PCT Filed: Oct. 15, 2008

(86) PCT No.: PCT/EP2008/008714

§ 371 (c)(1),
(2), (4) Date: May 4, 2010

(87) PCT Pub. No.: WO2009/049868

PCT Pub. Date: Apr. 23, 2009

(65) Prior Publication Data

US 2010/0236314 A1 Sep. 23, 2010

(30) Foreign Application Priority Data

Oct. 16, 2007 (DE) ..... 10 2007 051 047

(51) Int. Cl.
*B24B 21/00* (2006.01)

(52) U.S. Cl.
USPC ..... 451/303; 451/174; 451/168; 451/317; 451/489

(58) Field of Classification Search
USPC ..... 451/303, 174, 168, 163, 49, 317, 451/489, 495, 539
See application file for complete search history.

(56) References Cited

U.S. PATENT DOCUMENTS

| | | | | | |
|---|---|---|---|---|---|
| 1,013,980 | A | * | 1/1912 | Wysong | 451/302 |
| 2,637,956 | A | * | 5/1953 | Nuessle | 451/539 |
| 3,123,947 | A | * | 3/1964 | Rawley | 451/495 |
| 3,283,447 | A | * | 11/1966 | Cretsinger | 451/303 |
| 3,566,549 | A | * | 3/1971 | Briton | 451/355 |
| 3,774,355 | A | * | 11/1973 | Dawson et al. | 451/527 |
| 3,874,126 | A | * | 4/1975 | Catlin et al. | 451/525 |
| 4,084,356 | A | * | 4/1978 | Brears | 451/59 |
| 4,142,334 | A | * | 3/1979 | Kirsch et al. | 451/539 |

(Continued)

FOREIGN PATENT DOCUMENTS

| | | | |
|---|---|---|---|
| DE | 879368 | C | 6/1953 |
| DE | 284635 | A5 | 11/1990 |

(Continued)

OTHER PUBLICATIONS

International Preliminary Report on Patentability issued in connection with International Application No. PCT/EP2008/008714.

(Continued)

*Primary Examiner* — George Nguyen
(74) *Attorney, Agent, or Firm* — Akerman Senterfitt

(57) ABSTRACT

A pressing device (50) for pressing cutting means onto circumferential surfaces (12) of substantially cylindrical workpiece portions (13) during a finishing operation is provided for pressing the cutting means onto a circumferential surface with a pressing force over a contact angle. The pressing device is steplessly adaptable for the machining of workpiece portions of differing diameters that have a diameter difference of at least 0.1 mm.

13 Claims, 6 Drawing Sheets

(56) References Cited

U.S. PATENT DOCUMENTS

| | | | | |
|---|---|---|---|---|
| 4,682,444 | A * | 7/1987 | Judge et al. | 451/49 |
| 4,979,335 | A | 12/1990 | Weber et al. | |
| 5,593,340 | A * | 1/1997 | Nelson et al. | 451/42 |
| 5,651,719 | A * | 7/1997 | Pineau | 451/8 |
| 5,683,291 | A * | 11/1997 | Humpert et al. | 451/168 |
| 5,695,391 | A * | 12/1997 | Steinwender | 451/168 |
| 5,700,187 | A * | 12/1997 | Balbi | 451/495 |
| 5,954,571 | A * | 9/1999 | Case | 451/354 |
| 5,984,767 | A * | 11/1999 | Pineau et al. | 451/302 |
| 6,080,051 | A * | 6/2000 | Weber | 451/303 |
| 6,102,783 | A * | 8/2000 | Loock et al. | 451/173 |
| 6,203,402 | B1 * | 3/2001 | Hildebrandt | 451/8 |
| 6,286,498 | B1 * | 9/2001 | Sung | 125/12 |
| 6,309,287 | B2 * | 10/2001 | Martin et al. | 451/303 |
| 6,354,929 | B1 * | 3/2002 | Adefris et al. | 451/527 |
| 6,454,638 | B2 * | 9/2002 | Bonachera et al. | 451/303 |
| 7,048,618 | B1 * | 5/2006 | Cramer | 451/59 |
| 7,413,498 | B2 * | 8/2008 | Omata et al. | 451/5 |
| 7,553,221 | B2 * | 6/2009 | Hope et al. | 451/495 |
| 2002/0086627 | A1 * | 7/2002 | Andrews et al. | 451/355 |
| 2003/0003854 | A1 | 1/2003 | Deware et al. | |
| 2006/0258276 | A1 * | 11/2006 | Sung | 451/527 |

FOREIGN PATENT DOCUMENTS

| | | | |
|---|---|---|---|
| DE | 19607775 | A1 | 9/1997 |
| DE | 29819442 | U1 | 1/1999 |
| DE | 19921043 | A1 | 11/2000 |
| DE | 10332605 | A1 | 2/2005 |
| EP | 0781627 | A1 | 7/1997 |
| EP | 1112811 | A2 | 7/2001 |
| EP | 1506839 | A1 | 2/2005 |
| EP | 1514640 | A2 | 3/2005 |
| EP | 1837121 | A1 | 9/2007 |
| FR | 1329559 | A | 6/1963 |
| JP | 11320374 | A | 11/1999 |
| JP | 2004058241 | A | 2/2004 |

OTHER PUBLICATIONS

Office Action issued in connection with corresponding Chinese patent application (Appln No. 200880121273.4).

* cited by examiner

PRESSING DEVICE FOR CUTTING MEANS AND APPARATUS AND METHOD FOR FINISHING CIRCUMFERENTIAL SURFACES ON CYLINDRICAL PARTS OF A WORKPIECE

FIELD OF APPLICATION AND PRIOR ART

The invention relates to a pressing device for pressing cutting means onto circumferential surfaces of substantially cylindrical workpiece portions during a finishing operation, to an apparatus for finishing equipped with at least one such a pressing device, and to a method for finishing circumferential surfaces of substantially cylindrical workpiece portions.

Finishing is a fine-machining process, by means of which the circumferential surfaces of substantially cylindrical workpiece portions on workpieces such as crankshafts, camshafts, gear shafts or other components for motor engines and work machines are machined in order to produce a wanted surface fine-structure. In the case of finishing, a machining tool that is fitted with a granular cutting means is pressed with a pressing force over a contact angle, by means of a pressing device, onto the circumferential surface to be machined. In order to generate the cutting speed necessary for the removal of material, the workpiece is rotated about its workpiece axis. At the same time, there is generated a relative motion between the workpiece and the machining tool bearing on the circumferential surface, which relative motion oscillates parallelwise in relation to the workpiece axis. For this purpose, the workpiece can be put into an axial oscillating motion. Alternatively, or in addition, it is also possible for the oscillating motion to be generated by the machining tool. The combination of the rotational motion of the tool and the superimposed oscillating motion enables a so-termed cross-hatch pattern to be produced, as a result of which the machined workpiece circumferential surfaces are particularly suitable, for example, as running surfaces for plain bearings or rolling-contact bearings or the like. The workpiece portion to be machined may be, for example, a main bearing or a lifting bearing of a crankshaft, or a camshaft bearing.

Differing machining tools may be used. In the case of so-termed belt finishing, a finishing belt is pressed onto the workpiece surface by means of a pressing device. A finishing belt has a belt-shaped, flexible substrate, with cutting grains applied, by means of a binding agent, on the front side that is to be directed towards the workpiece. Frequently, a tear-resistant, low-stretch polyester film serves as a substrate material for the grain and binding agent structure. Sometimes fabric belts are also used. The finishing belt used for machining can be advanced following completion of a machining cycle or in the course of a machining cycle, such that in each case a fresh cutting means is available for the removal of material. Reliably reproducible results can thereby be achieved.

So-termed finishing stones can also be used as a machining tool. These finishing stones are substantially rigid cutting bodies, wherein the granular cutting means is bound by synthetic resin, or bound ceramically or galvanically (in a metal matrix) or in another manner. Frequently, the side of the grinding bodies that faces towards the workpiece is profiled according to the geometry of the workpiece surface to be machined, in order to ensure a large-area machining contact.

In the case of conventional apparatuses for finishing by means of belt finishing, pressing devices having so-termed finishing shoes are used to press a finishing belt onto the workpiece surface to be machined. A finishing shoe has a substantially C-shaped pressing portion, the radius of curvature of which is so matched to the solid diameter of the workpiece portion to be machined, the thickness of the finishing belt being taken into account, that the finishing belt is pressed substantially flatly onto the circumferential surface of the workpiece portion by means of the finishing shoe during machining. By means of such substantially rigid pressing elements, the contour of the finishing tool can be imparted to the workpiece portion to be machined, such that a selective setting of the macro-form of the workpiece portion is possible. If a workpiece portion of a different diameter is to be machined, it is necessary for the pressing element to be exchanged for a pressing element having a correspondingly different radius of the C-shaped portion.

Known from EP 0 781 627 B1 is an apparatus for finishing that is equipped with a finishing element that is of such flexibility that it can adapt radially, in respect of circle geometry, to the surface to be machined. The flexibility in this case is so designed that the pressing element can only bear, substantially, on a workpiece of the same diameter, this diameter being able to be altered, however, through biasing of the drive element, in the range of a few micrometers (μm). In this case, likewise, the pressing elements have to be exchanged for pressing elements of different dimensions if, following machining of a first workpiece portion of a first diameter, a workpiece portion of a second diameter differing significantly therefrom is to be machined on the same workpiece or on another workpiece.

Since the changing of the pressing elements is not straightforward, there have already been proposed pressing elements by means of which workpiece portions of diameters of differing magnitudes can be machined.

A pressing element for a belt finishing machine is known from EP 1 506 839 B1, which pressing element has a C-shaped portion by means of which a finishing belt can be pressed onto a workpiece surface. The C-shaped portion has at least two partially hollow-cylindrical bearing regions, which have differing radii of curvature. The differing radii of curvature of the two bearing regions in this case correspond to the required diameters of two workpiece portions, of differing diameters, that are to be machined. Consequently, workpieces that have, for example, bearing locations of differing diameters can be machined in a single machining station.

Known from DE 196 07 775 A1 is a finishing apparatus having pressing elements that each have two contact-surface portions, the curvature of which is somewhat less than the curvature of the workpiece contour to be machined. Owing to the small differences in curvature, instead of there being formed two theoretically linear contacts there is formed, respectively, at two regions spaced apart from one another in the circumferential direction, a contact zone having a variable contact pressure and variable workpiece stock removal. Owing to the elliptical or ogival overall contour of the pressing surfaces, it is also possible, by means of such pressing devices, to machine workpiece portions of differing diameters, in which case the circumferential distance between the contact zones formed would then differ in each case.

OBJECT AND ACHIEVING OF THE OBJECT

The invention is based on the object of providing a method and an apparatus for finishing circumferential surfaces on substantially cylindrical workpiece portions, which method and apparatus allow workpieces having workpiece portions of differing diameters to be machined with a small amount of apparatus resource, and thereby allow a high surface quality to be achieved, irrespective of the diameter of the workpiece portions.

To achieve this object, the invention provides a pressing device having the features of claim 1, and provides an apparatus having the features of claim 29, and a method having the features of claim 30.

Advantageous developments are specified in the dependent claims. The content of all claims is made through reference to the content of the description.

A distinctive feature of the pressing device consists in that the pressing device is steplessly adaptable for the machining of workpiece portions of differing diameters that have a diameter difference of at least 0.1 mm. This stepless adaptation becomes possible because of the design of the pressing device, such that there is no need to change pressing devices if workpiece portions of differing diameters, having a diameter difference of 0.1 mm or more, are to be machined. Owing to this capability of the pressing device to adapt to greatly differing diameters, it is possible for a large-area machining contact to be formed between the abrasive side of the finishing belt, or the cutting bodies fitted with cutting means, and the workpiece surface, in the case of all diameters in the diameter range in the machining over the entire contact angle defined by the pressing device, as a result of which high-quality surfaces can be produced.

The adaptation of the pressing device to the diameter of the workpiece portion is thus effected with alteration of the geometry of the pressing device, the pressing device being designed, in respect of its structure, for relatively large, defined alterations of geometry, i.e. for relatively large alterations of the curvature of the pressing surface provided by the pressing device. Since, in the case of pressing devices according to the invention, the pressing device adapts, or can be adapted, steplessly to the diameter of the workpiece portion, large-area machining is possible in the entire diameter range, as a result of which high surface qualities are achievable.

By means of pressing devices according to the invention, it is possible to machine each diameter in a predefined diameter range $\Delta D = D_{MAX} - D_{MIN}$ between a minimum diameter $D_{MIN}$ and a maximum diameter $D_{MAX}$, it being possible, in the case of each diameter, to ensure a flat contact, with a rated pressing force, or pressing-force distribution, between the cutting means and the workpiece surface to be machined.

In the case of several embodiments, the diameter difference can be at least 1% or at least 5% or at least 10% and also, in the case of other embodiments, at least 15% or at least 20%. Several pressing devices are designed in such a way that each diameter can be machined in a diameter range having a diameter difference $\Delta D$ of at least 0.1 mm or at least 1 mm between a minimum and a maximum diameter in the case of a mean diameter between 20 mm and 70 mm. Several embodiments are so designed, for example, that each diameter can be machined in a diameter range between approximately 50 mm and approximately 70 mm. Consequently, for example, the majority of crankshafts of standard automobile engines can be successfully machined by means of a single type of pressing device. Clearly, pressing devices can also be designed for other diameter ranges, for example for a diameter range having a diameter difference of at least 2 mm or at least 8 mm or at least 15 mm or more, e.g. in the case of a mean diameter of 20 mm or 40 mm or 50 mm or 60 mm or more. In this way, a relatively large diameter range can be covered with a single pressing device or with few pressing devices. For the machining of shafts, it may be appropriate, for example, to cover a diameter range of approximately 20 mm to approximately 80 mm. It is thereby possible to machine, for example, shafts for compressors, the mean diameter of which shafts is frequently in the region around 20 mm. In the case of crankshafts for automobiles, typical diameters are frequently in the order of magnitude of approximately 50 mm, such that, for example, diameter ranges between 40 and 50 mm and/or 50 and 60 mm can be covered. In the case of crankshafts for trucks, the typical diameters are usually somewhat greater, for example in the region around 70 mm.

The pressing device can be so designed that the adaptation of the pressing device to the diameter of the workpiece portion is performed in a self-acting, or automatic, manner, with alteration of the geometry of the pressing device, when the cutting means is pressed onto the curved circumferential surface of the workpiece portion by means of the pressing device. Such pressing devices are also referred to in the following as "passive" pressing devices, and are characterized in that the pressing forces that occur during pressing are used to set the correct diameter.

In the case of other variants, the pressing device is designed as an adjustable pressing device whose pressing geometry—determined by the radius of curvature of the pressing surface (s) to be pressed onto the back side of the finishing belt—can be steplessly adapted, automatically or by an operator, to the diameter of the workpiece portion by means of one or more positioning elements, e.g. adjusting screws, before the pressing device presses the cutting means onto the workpiece. Such devices are also referred to in the following as "active" or "actively settable" pressing devices. Following setting, as a rule, the respectively set radius of curvature of the pressing surface(s) is a fixed default and, insofar as possible, unalterable, such that such pressing devices can also be used for shape correction, or for altering the diameter of the machined workpiece portion.

Pressing devices according to the invention render possible fine-machining processes in which the same pressing device is used to machine firstly a first workpiece portion, of a first diameter, and subsequently to machine a second workpiece portion, of a second diameter that differs from the first diameter, a stepless adaptation of the pressing device to the respective diameters being effected in each case.

In the case of several embodiments, the pressing device comprises at least one elastically flexible pressing band, which is fastened to two bearings of a carrier element that are arranged at a distance from one another. The flexibility of the pressing band enables the front side of the pressing band that faces towards the workpiece to bear on the workpiece surface, or on the back side of the finishing belt, over a large area in the case of each diameter within a predefined diameter range, in order to transfer the pressing force onto the cutting means. The pressing band can also carry further elements on its front side for the purpose of transferring the pressing forces.

The material, or a material combination, of the pressing band should be substantially inelastic in the band direction, such that the band length between the bearings does not alter substantially even under load. It is thereby possible to transfer even large pressing forces, if necessary, in the case of differing diameters.

The pressing band can comprise, for example, at least one metal band composed of a resilient metal, in particular of spring steel. It is possible in this case for the pressing band to be constituted exclusively by such a metal band, and not to have any further elements. It is also possible, however, for yet further elements to be provided in addition to the at least one metal band, in order, for example, to impart a particular configuration and/or particular elasticity properties to the front side that faces towards the workpiece. For example, the metal band can have a layer of rubber-elastic material on its front side, in order to impart a limited elastic resilience to the pressing side.

In the case of several embodiments, the pressing band is composed, substantially, of a rubber material, which can be reinforced, for example, by inelastic fibers extending in the band direction. It is also possible for the pressing band to be made of an appropriate plastic material, or for plastic material to be used in the production of the pressing band. Also possible is a design whereby the pressing band has a fabric band. A plurality of materials can be combined in a composite material, in order to achieve the wanted elastic flexibility perpendicularly relative to the band direction with, at the same time, high tensile strength in the band direction.

In the case of several embodiments, which provide for machining without a finishing belt, a cutting means, for machining the workpiece surface, is fastened to a front side of the pressing band that is to be directed towards the workpiece. For example, a front side that is to be directed towards the workpiece can carry a cutting-means layer having cutting grains bound in a binding. The pressing band thus acquires a large-area abrasive front side that, owing to the elastic flexibility of the pressing band, can adapt over a large area to the workpiece surface. The layer can be, for example, a cutting-means layer in which diamond grains or ceramic grains are present, in a galvanically applied binding, on the front side of a metallic pressing band.

It is also possible for a plurality of cutting bodies, mutually spaced apart from one another, to be arranged on the front side of a pressing band that is to be directed towards the workpiece. The cutting bodies can be, for example, cutting strips that are arranged at a distance from one another in the band direction, and that are fastened to the front side by soldering, adhesive bonding or in another manner. The strip-shaped cutting bodies can extend substantially over the entire width of the pressing band or, also, if appropriate, over only a portion thereof. As a rule, three or more such mutually spaced apart cutting bodies are provided. The contact surfaces facing towards the workpiece can be adapted to the workpiece geometry through profiling. In the case of several variants, very many strip-shaped cutting bodies are applied next to one another at a distance in the band direction (longitudinal direction), for example more than 3 or more than 5 or more than 10 or more than 15 strip-shaped cutting bodies, e.g. between 5 and 10 such cutting bodies. In the case of cutting bodies of small width, profiling of the contact surface facing towards the workpiece can be dispensed with, if appropriate, whereby production is simplified and rendered more cost-effective. Moreover, this enables greater diameter ranges to be covered.

In the case of several embodiments, a two-dimensionally extended array of relatively small cutting-means zones, the mean diameter of which is substantially smaller than the width of the pressing band transversely relative to the band direction, is arranged on the front side of the pressing band that is to be directed towards the workpiece. The small cutting-means zones are also referred to in the following as "pads". These can be spots of cutting means applied to the metallic pressing band by means of a perforated mask in a coating process. The pads can also be constituted by small cutting-means bodies, which are fastened to the front side of the pressing band, in the wanted arrangement, by adhesive bonding, soldering or in another manner. The cutting-means zones can have, for example, a rectangular cross-section with unequal or equal edge lengths, but they can also be round or oval. Preferably, the mean diameter of a cutting-means zone is 8 mm or less, for example in the range between approximately 1 mm and approximately 5 mm. The mutual spacing of the cutting-means zones can be of the same order of magnitude, but can also be greater or less if appropriate. The cutting-means zones should not contact one another, however. There can thereby be provided a two-dimensionally extended array of cutting-means zones, between which there extend in a plurality of directions channels that are free of cutting means. The surface proportion of the channels can be of a similar order of magnitude as the surface proportion of the cutting-means zones, such that a reliable removal of stock is ensured. The cutting-means zones can be distributed non-uniformly or substantially uniformly within the array. A non-uniform distribution can be advantageous, for example, if certain forms of the workpieces to be machined are to be produced. Frequently, however, a uniform distribution is advantageous, in order to ensure a correspondingly uniform removal of material.

The provision of a two-dimensionally extended array of relatively small cutting-means zones can also be appropriate, irrespective of the presence of an elastically flexible pressing band, in the case of pressing devices for finishing that have a substantially rigid pressing geometry. For example, a rigid pressing element can have a substantially C-shaped, largely cylindrically curved pressing portion, the concave inside of which is provided with an array of such cutting-means zones.

In the case of embodiments of pressing devices intended for belt finishing, the front side of the pressing band that is directed towards the workpiece can be substantially smooth and be constituted, for example, by the front side of a metal band produced through rolling.

In the case of several embodiments for belt-finish machining, anti-slip means, which impede slippage of the finishing belt relative to the pressing band when the pressing device is pressed on, are provided on a front side of the pressing band that is to be directed towards the finishing belt. The surface quality that is achievable in the machining operation can thereby be improved. The anti-slip means can be constituted by an appropriate roughness of the front side. In the case of several embodiments, the front side of the pressing band is provided with fine-grain cutting material, which, for example, can be applied to a metallic pressing band by means of a galvanic coating. As a rule, separate anti-slip means are not necessary in the case of use of a finishing belt coated with cutting means on both sides.

In the case of several embodiments, a plurality of pressing elements, which are composed of an elastically resilient material and arranged in an offset manner in the band direction, are applied on a front side of the pressing band that is to be directed towards the finishing belt. Greater surface pressures, and consequently removal of greater thicknesses of material, can thereby be achieved.

An elastically flexible pressing band can be fastened to the associated carrier element in differing ways. In the case of several embodiments, the bearings on the carrier element are at a fixed distance in relation to one another, such that the capability of the pressing device to be adapted to differing diameters results exclusively from the elastic flexibility of the pressing band. The pressing band can be constrained in a self-supporting manner between the two fixed bearings, such that a concave arc shape is obtained on the front side when in the load-free state. As a rule, in the case of such embodiments, the pressing length with which the pressing band bears on the back side of the finish belt, or the contact length on the workpiece, will vary with differing diameters. In the case of other embodiments, at least one of the bearings is arranged so as to be movable on the carrier element. For example, one of the bearings can be realized as a fixed bearing, while the other bearing is a movable bearing. The fastening point of the pressing band can be fastened to the carrier element so as to be movable, for example linearly displaceable or pivotable. A situation can thereby be achieved whereby the same pressing length, or contact length, is present in each case in the intended diameter range in the case of differing diameters, such that, in the case of differing diameters and a pressing force that is equal in each case, substantially the same surface pressure on the workpiece surface is obtained.

In the case of an embodiment intended for belt finishing, the pressing device comprises two deflection devices, arranged with a mutual spacing in relation to one another, for deflecting a finishing belt guided under tension via the deflection devices, which finishing belt constitutes between the deflection devices a finishing belt portion guided with a belt tension, the deflection devices being arranged on opposing sides of the workpiece portion, the pressing device being in a working position, in such a way that the finishing belt portion, under tension, over a wrap contact angle determined by the relative position between the deflection devices and the workpiece portion, bears flatly on the circumferential surface. The deflection devices can be realized so as to be movable, for example as rotatable deflection rollers. It is also possible for one or more fixed deflection devices to be provided with curved deflection contours. The deflection elements can be constituted, for example, by metal rollers having a cylindrical outer contour. It is also possible for the deflection elements, on an outer portion provided for guiding the finishing portion, to be composed of an elastically resilient material. In particular, in such cases a deflection element can also serve as a pressing element, in order to press the finishing belt directly onto the workpiece surface.

In the case of each of these variants, it is ensured that the finishing belt portion, over a wrap contact angle determined by the relative position between the deflection devices and the workpiece portion, bears flatly in an uninterrupted manner on the circumferential surface, whereby a particularly gentle machining is possible. The wrap contact angle in this case can be set and steplessly altered through alteration of the relative position between the deflection devices and the workpiece portion.

In the case of several embodiments, the pressing force is determined exclusively through the belt tension of the tensioned finishing belt portion. By means of a finishing-belt tensioning device for the variable setting of the belt tension of the finishing belt, differing belt tensions, and consequently differing pressing forces, which, in combination with the ability to alter the wrap contact angle, permit a large range of differing surface pressures, can be set in a stepless manner.

In the case of several method variants, provision is made whereby the deflection elements are shifted into the proximity of the workpiece portion, in such a way that the finishing belt is pressed directly onto the workpiece surface by the deflection elements. Greater pressing forces can thereby be generated in the region of the deflection elements than can be generated solely through the belt tension of the finishing belt portion. Linear contact regions can be realized. In the case of deflection elements having an elastically resilient outer surface, broader contact zones can also be realized, such that pressure force peaks can be prevented.

In the case of the variants having a freely tensioned finishing belt portion, the pressing forces, or surface pressures, that can be achieved are limited by the tensile force of the finishing belt. In the case of several embodiments, the pressing device comprises a separate pressing unit, which acts on the back side of the finishing belt portion, for the purpose of pressing the finishing belt portion, tensioned between the deflection devices, onto the workpiece portion. The pressing force acting on the workpiece surface can thereby be decoupled from the belt tension of the finishing belt, and greater pressing pressures, or surface pressures, can be achieved.

In the case of a variant, the pressing device comprises a supporting belt, guided between the finishing belt and the deflection devices, for supporting, on the back side, the finishing belt that bears on the workpiece portion. By means of a supporting-belt tensioning device, the belt tension of the supporting belt can be set in a variable and preferably stepless manner. The supporting belt in this case can be put under tension in such a way that the finishing belt is pressed onto the circumferential surface, by means of the supporting belt, with a pressing force determined by the belt tension of the supporting belt. Although a portion of the pressing force can also result from a belt tension of the finishing belt, as a rule in such cases the finishing belt is non-tensioned and only bears on the supporting belt.

The supporting belt is preferably made from a belt material that has a greater tensile strength than the material of the finishing belt, such that greater pressing forces can be generated than would be possible solely through the belt tension of the finishing belt. This results in additional latitude in the selection of material for the finishing belt.

The pressing force can be generated, so as to be controlled in respect of its path or controlled in respect of its force, by means of the supporting belt or another, separate pressing unit, and can therefore be specifically predefined.

In the case of several method variants of the belt-finish machining, the finishing belt rests during the machining, such that the cutting speed is generated exclusively by the rotary motion of the workpiece and the superimposed axially oscillating relative motion between the workpiece and tool (finishing belt). At regular or irregular intervals of time, a used finishing belt portion can be replaced by a fresh finishing belt portion, in that the finishing belt is advanced by a predefined belt advance distance during a pause in machining, the finishing band being free of load. However, feeding of the belt does not have to be effected during a pause in machining. Rather, advancing of the belt can also be effected during the machining contact, such that the advancing of the belt contributes to the cutting speed. The supporting belt and the contacting finishing belt in this case can move in the direction of rotation of the workpiece, but motion contrary to the rotation of the workpiece is also possible, greater displacement forces being required for this purpose. The supporting belt, during belt feeding of the finishing belt, is preferably advanced synchronously with the finishing belt, at the same speed, such that the finishing belt and the supporting belt are not moved relative to one another. In the case of several embodiments, a feed device, for moving the supporting belt during belt feeding of the finishing belt, is provided for this purpose. It is also possible, in principle, for the feeding of the supporting belt to be made independent of the feeding of the finishing belt, if this is required, or for the supporting belt not to be moved at all.

Preferably, the supporting belt is designed as an endless belt. This facilitates integration of the supporting belt into the pressing device, such that the supporting belt can be removed or fitted, without resource requirement, together with a pressing device. Generation of the required belt tension of the supporting belt is also simplified by an endless-belt design.

In the case of a development, the pressing device comprises a carrier element, on which at least two pressing elements, which are arranged with mutual spacing in relation to one another and comprise pressing surfaces to be directed towards the workpiece, are pivotally mounted in such a way that the pressing elements, upon the pressing surfaces bearing on a back side of a finishing band bearing on the workpiece portion, become aligned relative to the workpiece portion in such a way, for example substantially radially, that the pressing surfaces bear substantially flatly on the back side of the finishing belt. For example, three or more pressing elements, pivotally mounted so as to be independent of one another, can be provided, which pressing elements are preferably arranged symmetrically and/or at equal circumferential distances in relation to one another. The pivotability of the pressing elements enables the pressing device to be adaptable to differing diameters. The direct mounting on the carrier element allows relatively large pressing forces to be generated. The pressing elements can be designed with an elastically somewhat resilient material, at least in the region of the pressing surfaces, to enable the pressing surfaces to adapt, to a limited extent, to differing curvatures of the workpiece surface.

In addition to their disclosure by the claims, these and further features are also disclosed by the description and the drawings, the individual features each being realized singly per se or multiply in the form of sub-combinations in the case of an embodiment of the invention and on other domains, and being able to constitute advantageous realizations and realizations that are patentable per se. Exemplary embodiments of the invention are represented in the drawings and explained more fully in the following.

SHORT DESCRIPTION OF THE DRAWINGS

DETAILED DESCRIPTION OF PREFERRED EXEMPLARY EMBODIMENTS

Figure 1:
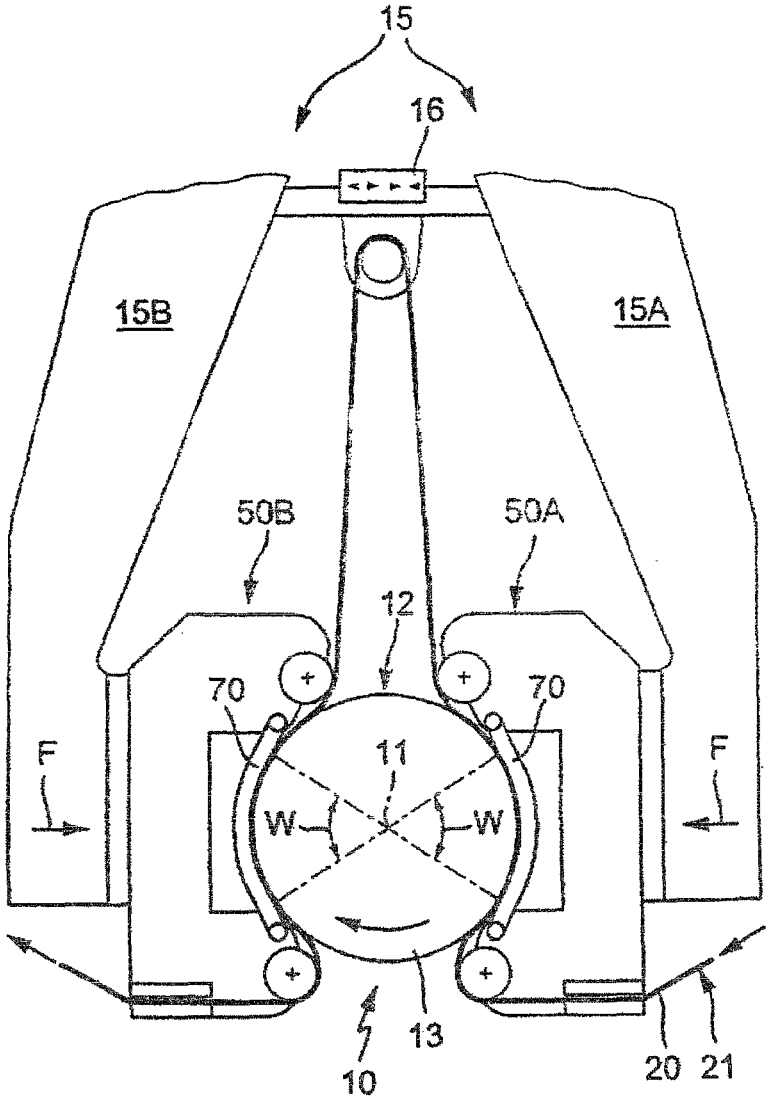
FIG. 1 shows a schematic, partial view of a finishing unit having two gripper-type machining arms, which can be pivoted towards one another and carry pressing devices that press a finishing belt onto a cylindrical workpiece portion of a crankshaft.

Shown schematically in FIG. 1 is a portion of an apparatus, designed as a belt finishing machine, for finishing circumferential surfaces of substantially cylindrical workpiece portions on workpieces such as crankshafts or camshafts. The apparatus is set up to machine a workpiece 10 in the form of a crankshaft. The workpiece is rotated about its main axis 11 (workpiece axis) by a rotary device, not shown, and at the same time, by means of an oscillation device, is put into an axially short-stroke, oscillating motion with strokes in the order of magnitude of some millimeters. The rotary device can have, for example, an electric geared motor, and the oscillation device can comprise a curve drive that is actuated in dependence on the workpiece rotation. The rotary device and the oscillation device can act, for example, on the output end of the crankshaft 10. The oscillation device can also comprise a drive that is independent of the workpiece rotation, e.g. a pneumatic or electromechanical oscillator.

The belt finishing apparatus has a plurality of finishing units that are arranged adjacently to one another on a common machine frame. The units are each very narrow, in order for adjacently located workpieces to be machined simultaneously. The apparatus shown has a plurality of finishing units for machining main bearings, and therebetween has finishing units for machining connecting-rod bearings of the crankshaft 10.

The finishing unit 15 in the form of a machining gripper shown portionally in FIG. 1 is intended for machining the substantially cylindrical circumferential surface 12 of a workpiece portion 13, which, in this case, is a main bearing of the crankshaft 10. In the case of appropriate accommodation of the finishing unit the lifting bearings can also be machined, for which purpose there are provided finishing units that follow the eccentric motion of the lifting bearings. The finishing unit 15 has two machining arms (finishing arms, pressure arms) 15A, 15B, which are mounted so as to be pivotable about parallel pivot bearings, not shown, in such a way that their free ends can be swiveled inwards, in the direction of the workpiece to be machined, or outwards, away from the workpiece. The machining arms can be moved hydraulically, pneumatically or mechanically towards one another or away from one another. In the case of the example, the machining arms are connected to one another via a hydraulic or pneumatic force generator 16, which allows the machining arms to press inwards, against the workpiece, with a predefined force F (arrows).

A finishing-belt delivery device, not shown in detail, provides a finishing belt 20, which is drawn off a supply roller, not shown, in the of the intake side of the finishing unit and which, after use, is guided from the output side of the finishing unit in the output direction 22, to a take-up roller for used finishing belt. The finishing belt 20 comprises a largely non-compressible, low-stretch polyester film, which is provided with granular cutting means on its front side 21 that is to be directed towards the workpiece. Other types of finishing belt can also be used, however, for example finishing belts having cutting means on a fabric backing, or finishing belts having cutting means on a paper backing. All usual cutting means can be used, for example ceramic cutting grains composed of aluminum oxide or silicon carbide, diamond cutting grains or cutting grains of cubic boron nitride or the like.

Fastened to each of the machining arms 15A, 15B, in the region of the free end, on the side that is to be directed towards the workpiece, is an exchangeable pressing device 50A, 50B, each of which is designed to press the finishing belt 20, provided with cutting means, onto the circumferential surface 12 of the workpiece in such a way that the finishing belt is pressed onto the circumferential surface with a pressing force provided for the machining operation, over a wrap contact angle W. The two pressing devices 50A, 50B shown in FIG. 1 are realized so as to be substantially identical and are aligned mirror-symmetrically in relation to one another, in order to machine diametrically opposing regions of the rotating workpiece portion. In this case, the finishing belt rests during the machining, such that the cutting speed required for the removal of material is generated exclusively by the rotational motion of the workpiece in combination with the superimposed axial oscillating motion, in order to produce on the workpiece surface a cross-hatch pattern that is advantageous for suitability on a plain bearing surface.

Figure 2A:
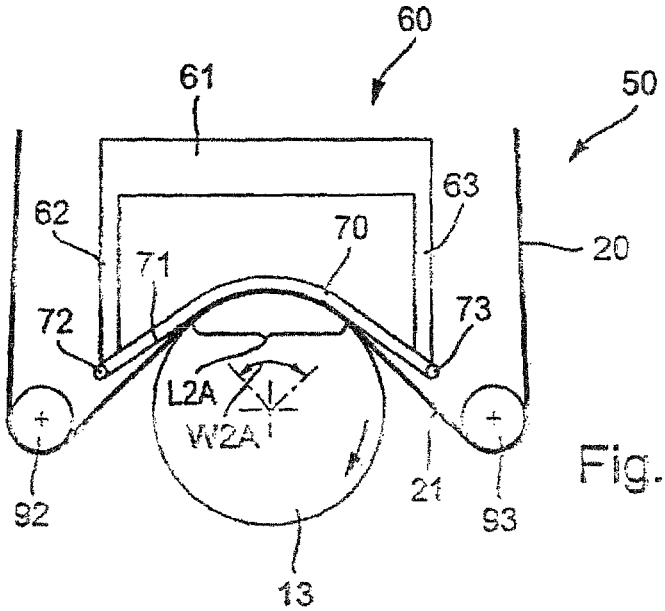
FIG. 2A shows an embodiment of a pressing device, having an elastically flexible pressing band, during machining of a workpiece portion of large diameter.
Figure 2B:
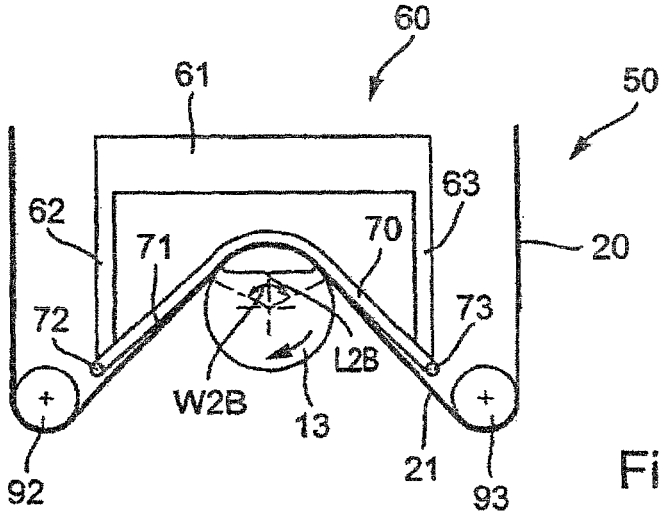
FIG. 2B shows the embodiment shown in FIG. 2A during the machining of a workpiece portion of lesser diameter.

The structure and functioning of the pressing devices 50A and 50B are explained more fully in the following in connection with FIGS. 1 and 2, FIG. 1 representing a variant of the embodiments shown in FIG. 2, and FIG. 2 showing the same pressing device 50, once in the case of the machining of a workpiece portion of relatively large diameter (FIG. 2A), and then in the case of the machining of a workpiece portion of a diameter that is significantly smaller in comparison therewith (FIG. 2B). The figures are not to scale. Depending on the application, typical diameter difference percentages can be, for example, 1% or more, e.g. 5% or more, 10% or more, or 20% or more. In absolute terms, diameter differences can be of the order of magnitude of one or more millimeters, e.g. more than 0.5 mm or more than 1 mm or more than 5 mm or more than 10 mm or more than 20 mm.

For reasons of clarity, the same references are used for corresponding elements.

A pressing device 50 has a rigid, substantially C-shaped carrier element 60 of tool steel, which, via its back side that faces away from the C opening, is screwed firmly, but exchangeably, onto the respective machining arm 15A or 15B, respectively. The single-piece carrier element is subdivided into a solid carrier portion 61, via which the pressing element is fastened to the respective machining arm, and two limb portions 62, 63, arranged at a distance from one another, which, in the mounted state, are directed towards the workpiece. Fastened between the free ends of the limb portions 62, 63 is an elastically flexible pressing band 70, the two ends of which are respectively fixed to the bearings 72, 73, at the free ends of the associated limb portions 62, 63, by screws or in another manner. The free length of the pressing band between the bearings 72, 73 is greater than the inside distance between the bearings, such that a curvature, directed into the inside of the carrier element, is already realized on the non-loaded pressing band in such a way that the non-loaded pressing band offers a largely cylindrically curved, concave pressing surface to be directed towards the workpiece.

In the case of the example, the pressing band 70 is a band of spring steel having a typical thickness in the range from 0.1 to 3 mm and a width, measured transversely relative to the band direction, that corresponds substantially to the width of the finishing belt 20, but which, if appropriate, can also be somewhat less than the width of the finishing belt. The front side 71 of the pressing band 70 that is to be directed towards the finishing belt carries an anti-slip means in the form of a layer of galvanically bound diamond grains of very fine granularity (for example, D10 or D20), which ensures that the finishing belt to be pressed on, when in the pressed-on state, cannot slip relative to the pressing element. In the case of other embodiments, the pressing band is composed, substantially, of an elastomer material that is preferably reinforced by inelastic fibers extending in the band direction.

For guiding the finishing belt into the space between the pressing band and the workpiece surface, the pressing device has two deflection devices 91, 92, in the form of cylindrical deflection rollers, which are arranged with mutual spacing in relation to one another and which, in the case of the variant of FIG. 1, are mounted on the respective limb portions of the carrier element, but in other cases can also be separately rotatably mounted outside of the carrier element. The deflection rollers can be mounted so as to be movable relative to the carrier element, in order to alter the relative position between the deflection rollers and the pressing band. The finishing belt is guided under tension via the deflection devices and, between the deflection devices, constitutes a finishing belt portion 21 tensioned with a belt tension. In the shown working positions of the pressing devices, the deflection rollers are arranged on opposing sides of the workpiece portion. The relative position between the deflection devices and the workpiece portion defines the wrap contact angle W over which the finishing belt bears flatly on the workpiece surface without interruption.

Prior to the machining of the workpiece portion, and with the pressing elements still lifted off, the finishing belt is guided through between the workpiece portion and the pressing element, and normally bears on the deflection rollers 91, 92 only when under tension. Upon the machining arms being swiveled inwards, the tensioned finishing belt then comes to lie around the respectively facing region of the workpiece portion, until the corresponding pressing band of the pressing device is pressed onto the outwardly facing back side of the finishing belt. Under the action of the force F provided by the machining arms, the pressing band then, changing its curvature, adapts flexibly to the diameter to be machined and, over a large area, in a single, coherent pressing region, presses the finishing belt, constrained between the pressing band and the workpiece surface, onto the workpiece portion.

Comparison of FIGS. 2A and 2B shows clearly that in this case differing wrap contact angles W and also differing contact lengths L of the finishing belt, measured in the circumferential direction, are obtained in dependence on the diameter of the workpiece portion to be machined. The contact length in this case is the length, measured in the circumferential direction of the workpiece surface, by which the finishing belt bears on the workpiece surface under a pressure generated by the pressing band. The band length of the pressing band between the two fixed bearings 72 and 73 is intended to be equal in FIGS. 2A and 2B, the pressing band being quasi inelastic, i.e. resistant to stretching, in the band direction. In the case of the relatively large diameter in FIG. 2A, a wrap contact angle W2A and a contact length L2A are obtained. In the case of the comparatively substantially smaller diameter of the workpiece in FIG. 2B, a somewhat greater wrap contact angle W2B>W2A is obtained, but with the contact length L2B being less than the contact length in the case of a larger diameter (L2B<L2A), owing to the lesser diameter of the workpiece portion. Thus, a greater curvature of the front side 71 of the pressing band, serving as a pressing surface, is realized in the case of relatively smaller diameters than in the case of greater diameters. The wrap contact angles and contact lengths, which are dependent on the workpiece geometry, are taken into account by the controller of the finishing machine for the purpose of setting the required surface pressure in the contact region of the finishing belt via a correspondingly predefined pressing force F. It is obvious that this embodiment of the pressing device is capable of adapting steplessly to workpiece portions of greatly differing diameters, both the wrap contact angle W and the contact length L varying in dependence on the diameter of the workpiece portion.

With the use of such pressing devices that can adapt, within a wide diameter range, to differing workpiece portion diameters, it is possible to construct a finishing machine in which all finishing units are equipped with identical pressing units. A set of finishing units in this case can act on relatively large lifting-bearing portions, while finishing units therebetween, having identical pressing devices, can act on lifting-bearing portions of comparatively smaller diameter.

Clearly, it is also possible for the same pressing device to be used to machine firstly a first workpiece portion, of a first diameter, and subsequently (without an intervening tool change) to machine, on the same workpiece or on another workpiece, a second workpiece portion, of a second diameter that differs from the first diameter, the pressing device adapting steplessly to the respectively differing diameters. In the case of many embodiments, the diameter difference can be in the range of one or more millimeters and/or in the range of 1% or more, for example in the range between approximately 50 mm and approximately 60 mm, but also above or below these.

In the case of passive, adaptive pressing devices, the diameter of the workpiece portion to be machined determines the geometry of the pressing element, when the latter is brought into the pressing position. In this case, the pressing element adapts to the geometry of the workpiece portion. Such pressing devices are therefore intended primarily for improving the surface quality of a workpiece portion in cases in which a shape correction is not necessary and is also not wanted. A shape correction, particularly for short-wave defects, is nevertheless possible in many cases, since the supporting belt cannot be uniformly deformed in all directions.

Figure 3:
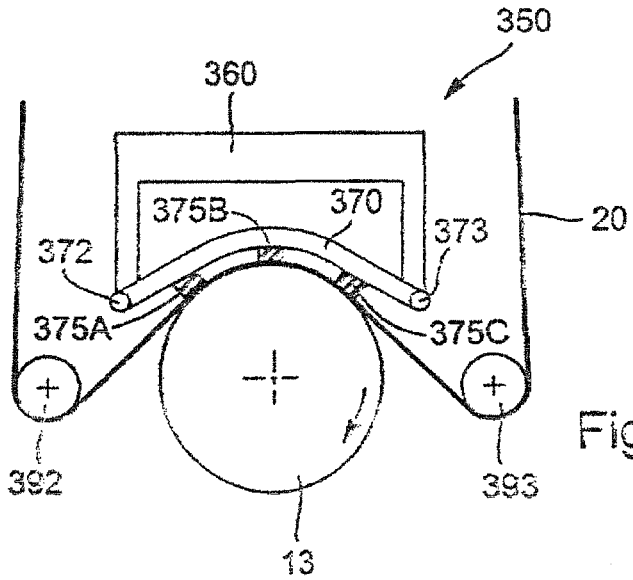
FIG. 3 shows an embodiment of a pressing device that comprises an elastically flexible pressing band having pressing elements on the workpiece side.

In the case of the embodiment of a pressing device 350 in FIG. 3, corresponding elements have references corresponding to those in the preceding figures, in each case from the number range between 300 and 399.

The basic structure of the pressing device 350, having a carrier element 360 and a pressing band 370, as well as deflection rollers 392, 393 and fixed bearings 372, 373, is substantially the same as in the case of the embodiments according to FIGS. 1 and 2. In contrast to those embodiments, however, three pressing elements 375A, 375B, 375C, which are composed of an elastically resilient material, for example of a relatively hard elastomer material, such as Vulkollan®, are fastened on the front side of the pressing band that is to be directed towards the finishing belt. Thus, the pressing band 370, when in the working position, does not bear directly on the back side of the finishing belt, but is supported on the back side via the pressing elements, which, in turn, press the finishing belt onto the circumferential surface of the workpiece portion at zones that are predefined and offset in the circumferential direction. Since the pressing elements press onto the finishing belt in spatially limited regions only, greater surface pressures can be generated in these regions, for an equal external pressing force F, than in the case of large-area bearing contact of a pressing band. Moreover, a more constant surface pressure is frequently possible. Furthermore, the supply of cooling lubricant and the removal of stock are facilitated.

In a variant that is not represented pictorially, a metallic pressing band is provided, on its front side that is to be directed towards the finishing belt, with a layer of an elastomer material, such that a large-area, uninterrupted bearing contact with the back side of the finishing belt is possible.

Figure 4:
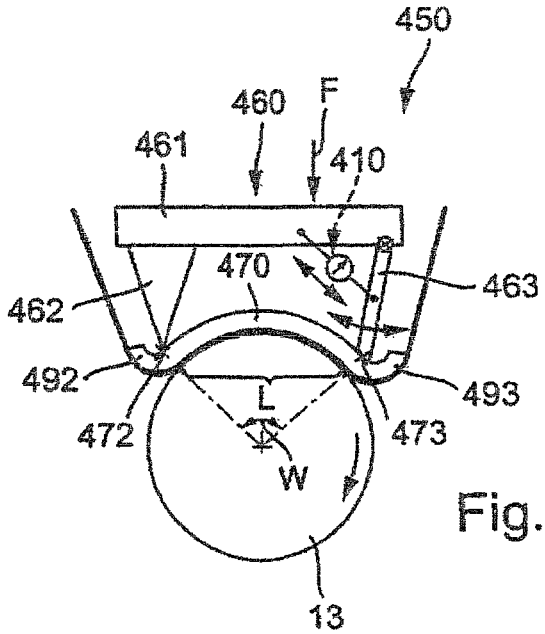
FIG. 4 shows an embodiment of a pressing device having an elastically flexible pressing band, which is fixedly mounted on one side and movably mounted on the opposite side.

Shown in FIG. 4 is an embodiment of a pressing device 450 that, in structure and function, differs fundamentally from the preceding embodiments. Here, likewise, the pressing device has a substantially C-shaped or U-shaped carrier element 460 having a solid base portion 461 and two limbs 462, 463 directed towards the workpiece. A metallic pressing band 470 is connected, at two bearings 472, 473 arranged at a distance from one another, to the free ends of the limbs 462, 463. While the limb 462 shown on the left constitutes a fixed bearing 472 for the pressing element, the limb 463 shown on the right is realized as a swivel arm, which is pivotally mounted both on the base portion 461 and on the facing end portion of the pressing band 470. A movable bearing is thereby constituted at the limb on the right, and the inside distance between the bearing points 472, 473 is variable and ensues in dependence on the diameter of the workpiece portion. This design also ensures that the contact length L along the circumference of the workpiece portion remains substantially the same, irrespective of the diameter, such that, with an equal pressing force F on workpieces of differing diameters, substantially the same surface pressure can be set for the finishing belt. The wrap contact angle W, on the other hand, changes in dependence on the diameter of the workpiece portion, in such a way that the wrap contact angle increases the smaller the diameter becomes.

In the case of this embodiment, deflection rollers, for guiding the finishing belt in the region between the pressing band 470 and the workpiece, were dispensed with. Instead, there are provided, at the free ends of the pressing band, deflection devices 492, 493 in the form of continuously curved guide surfaces, on which the finishing belt bears and on which it can slide during belt feeding in pauses in machining. Such a finishing belt guidance can also be provided in the case of the embodiments explained above, instead of the deflection rollers. Conversely, in the case of the embodiment in FIG. 4, separate deflection rollers can also be provided, instead of the formed-on guide surfaces.

The embodiments described thus far are examples of "passive" pressing devices, which are so designed that they adapt in a self-acting manner to the workpiece diameter to be machined. A variant of the embodiment of FIG. 4 is now to be used to explain an exemplary embodiment of an "actively" settable pressing device, which allows the effective radius of curvature of the pressing band to be preset over a large diameter range (diameter difference $\Delta D$ e.g. between 5 mm and 10 mm). For this purpose, the described variant having the freely swivelable movable bearing 473 can be so modified that the bearing 473 of the pressing band also becomes a fixed bearing, the inside distance between the fixed bearings 472, 473, however, being able to be steplessly fixed at differing values. For example, an optional adjusting device 410, in the form of a variable-length positioning element, can be provided between the solid base portion 461 and the swivelable limb 463. The one end of the positioning element is fastened to the base portion 461, the other end being fastened to the swivel lever 463 at a distance from the mounting by means of which the swivel lever 463 is fastened to the base portion 461. By means of an adjusting screw, or by other means, the length of the adjusting element 410 can be adjusted between its fastening points on the base portion 461 and on the swivel arm 463, such that the bearing point 473 can be adjusted in the direction of the fixed bearing 472, to reduce the mutual spacing, or it can be adjusted in the opposite direction, to increase the mutual spacing. If the mutual spacing of the bearing points 472, 473 is reduced, the radius of curvature of the pressing band 410 is also reduced, such that workpiece portions of a smaller diameter can be machined over a large area. If a workpiece portion of a greater diameter is to be machined subsequently, the inside distance between the fixed bearing points 472, 473 is increased by means of the positioning device 410, such that the pressing band reduces its curvature through an elongation, and a greater radius of curvature is set, which is adapted to the greater workpiece diameter. The actuation of the adjusting device 410 can be performed by an operator or, in the case of appropriate design of the pressing device, also automatically by the finishing apparatus itself.

Figure 5A:
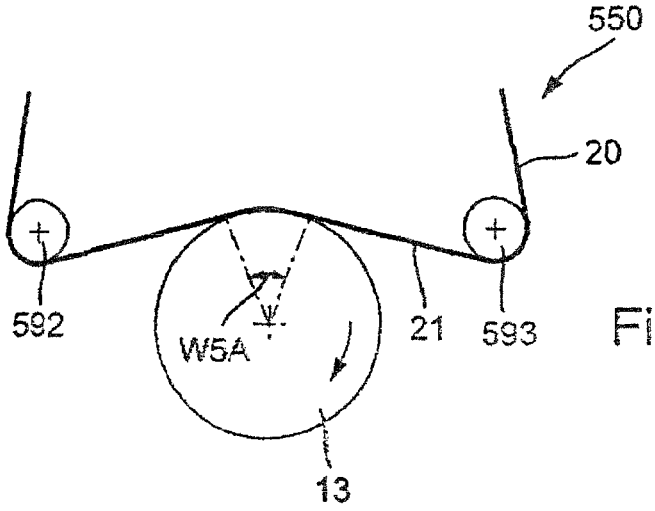
FIG. 5A shows an embodiment of a pressing device having a finishing belt portion freely tensioned between deflection rollers, in a first working position.
Figure 5B:
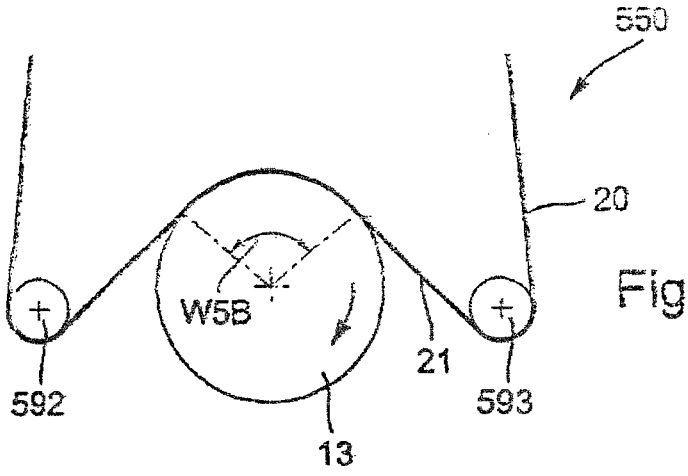
FIG. 5B shows the pressing device shown in FIG. 5A in a second working position, with a greater wrap contact angle.
Figure 6:
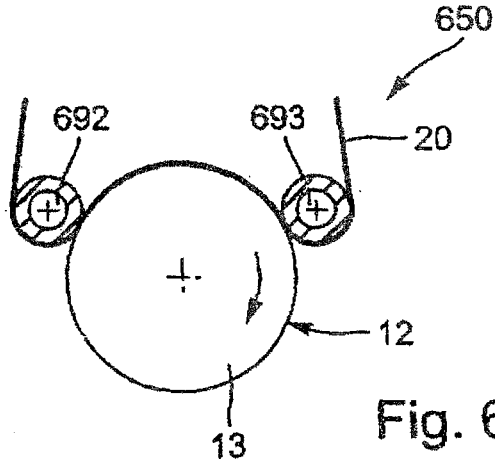
FIG. 6 shows an embodiment of a pressing device having deflection rollers, which are used to directly press the finishing belt onto the workpiece surface.

Pressing devices 550 and 650, each having two deflection devices, in the form of deflection rollers, which are arranged with mutual spacing in relation to one another and which serve to deflect a finishing belt guided under tension via the deflection device, are explained with reference to FIGS. 5 and 6, respectively. Between the deflection devices, the finishing belt constitutes a finishing belt portion tensioned with a belt tension. The belt tension of the finishing belt can be set variably in a stepless manner by means of a finishing-belt tensioning device, not shown.

As in the case of the embodiments according to FIGS. 1 to 3, the deflection rollers, in the shown working positions of the pressing device, are arranged on opposing sides of the workpiece portion in such a way that the finishing belt portion tensioned between them bears flatly, under tension, on the circumferential surface of the workpiece portion. As shown by comparison of FIGS. 5A and 5B, in this case the wrap contact angle W with which the finishing belt bears uninterruptedly on the workpiece portion is determined by the relative position between the deflection devices 592, 593 and the workpiece portion 13, in that, with the same diameter of the workpiece portion, a greater wrap contact angle (FIG. 5B) is obtained the further the pressing element is displaced in the direction of the workpiece portion (W5A<W5B). The wrap contact angle, and consequently the contact length, is thus steplessly settable through alteration of the relative position between the deflection devices and the workpiece portion. In the case of the pressing device 550, the pressing force acting in the wrap contact region, or in the region of the contact length, is set exclusively through the belt tension of the finishing belt, by means of the finishing-belt tensioning device.

For the purpose of increasing the specific surface pressure and the material removal rate resulting therefrom, the deflection devices can also be brought to the workpiece surface to such an extent that they directly press the finishing belt onto the workpiece surface. This is represented schematically in FIG. 6, through the pressing device 650. In the case of non-elastic rollers being used, such as those that can be used, for example, in the case of the embodiments shown above, there are thus produced two line contacts having increased surface pressure, which are arranged with circumferential spacing in relation to one another, the finishing belt bearing over a large area, with a lesser surface pressure, between the line contacts. In the case of the embodiment according to FIG. 6, the deflection rollers 692, 693 are composed, on the outer portion provided for guiding the finishing belt, of an elastically resilient material, for example of a relatively hard elastomer material. In this case, contact zones of increased surface pressure, which are narrow and flatly extended to a greater or lesser extent, can be produced by the elastic deformation of the deflection rollers, which deformation is represented in exaggerated form.

Figure 7:
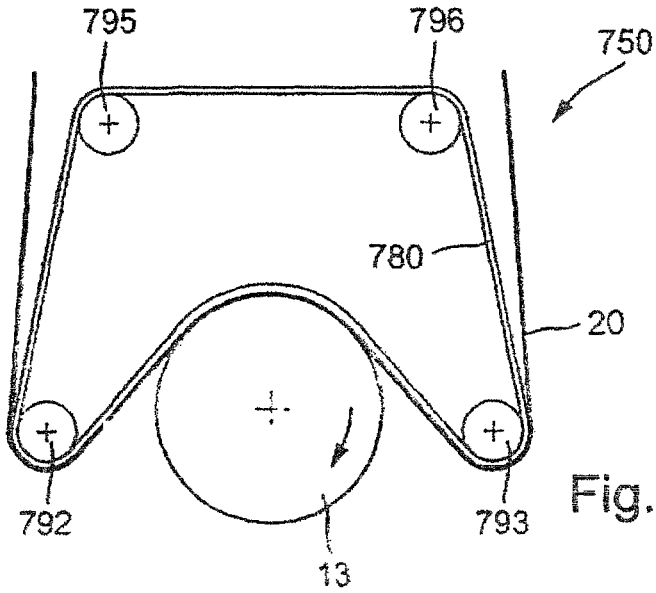
FIG. 7 shows an embodiment of a pressing device having an endless supporting belt.

In the case of the variants having a freely tensioned finishing belt portion (see FIGS. 5A and 5B), the surface pressure in the region of the wrap contact angle is limited by the tensile strength of the finishing belt. For the purpose of increasing the surface pressure in this region, the variant of a pressing device 750 shown in FIG. 7 has a supporting belt 780, guided between the finishing belt 20 and the roller-type deflection devices 792, 793, to support the back side of the finishing belt bearing on the workpiece portion 13. This supporting belt, or tensioning belt, can be realized so as to be more stable, and therefore transfer more tensile force, such that the surface pressure in the region of the wrap contact can thereby be increased. The supporting belt 780 is realized as an endless belt, and has a belt width that is slightly less than the width of the finishing belt. In the region of the deflection rollers 792, 793, the supporting belt is guided between the outside of the latter and the finishing belt, and, on the side facing away from the workpiece, is guided via two movably mounted deflection rollers 795, 796, which are assigned to a supporting-belt tensioning device for the variable setting of the belt tension of the supporting belt. It is evident that the belt tension of the endless belt 780 can be varied steplessly by shifting of the deflection rollers 795, 796 relative to the other deflection rollers 792, 793. The tensioning belt can be mounted so as to be fixed, i.e. immovable, in the belt direction, such that, in the case of belt feeding of the finishing belt between individual machining stages, the finishing belt is moved relative to the tensioning belt, along the latter. In the case of the embodiment shown, during belt feeding of the finishing belt the supporting belt moves synchronously with the latter, at the same speed. For this purpose, a separate feed device can be provided to move the supporting belt, which device, for example, drives one of the rollers 795, 796 during advancing of the finishing belt. Insofar as the finishing belt bears with sufficient pressing force on the supporting belt during belt feeding, it may also suffice to design the supporting belt so as to be passively movable, such that the supporting belt is carried along by the finishing belt during belt feeding.

In the case of a method variant, the finishing belt and the supporting belt are moved forward slowly at the same time during the machining contact, such that fresh, unused finishing belt is fed continuously or in stages during a machining phase. Particularly uniform machining results are thereby achievable. Moreover, a portion of the stock removal can be effected via the finishing belt, which can carry along removed stock upon being fed forward. In order to generate the advancing motion of the finishing belt and of the supporting belt bearing thereon, the rotary motion of the workpiece portion 13 can be used, in that one of the rollers 795, 796 is provided with a braking device, which can be actuated in a controlled manner, and which counters the driving force of the rotating workpiece portion and thus renders possible a progression of the finishing belt/supporting belt at a controlled speed and, if appropriate, with pauses. Active driving of the coordinated advance motion of the finishing belt and supporting belt during the machining operation is also possible. For this purpose, at least one of the rollers 795, 796 can be connected to a corresponding drive, for example an electric motor, which can be controlled, via the controller of the machining appliance, according to a predefinable program. This controlled progression of the finishing belt and supporting belt during a machining phase can be useful independently of the described diameter adaptation, and also provided in the case of pressing devices that are not designed for a stepless adaptation to differing diameters of a larger diameter range.

Figure 8:
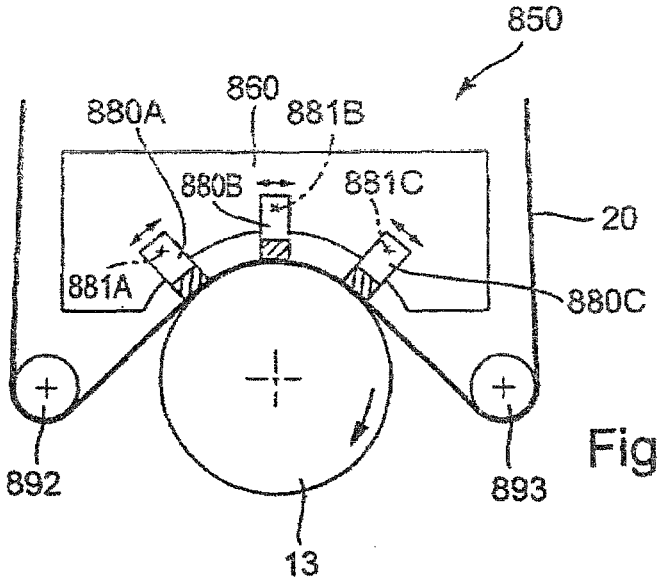
FIG. 8 shows an embodiment of a pressing device having a plurality of pivotable pressing elements.

In the case of the embodiment of a pressing device 850 in FIG. 8, similarly to the case of the embodiments of FIGS. 1 to 3 two deflection rollers 892, 893 are provided, whose relative position in relation to the workpiece portion can be used to determine the wrap contact angle. The pressing device moreover comprises a carrier element 860, which has a C-shaped recess on its side that faces towards the workpiece. Mounted along the circumference of the recess are three pressing elements 880A, 880B, 880C, arranged with mutual circumferential spacing in relation to one another. Each of the pressing elements is mounted so as to be pivotable to a limited extent, relative to the carrier element 860, about a pivot axis 881A, 881B, 881C aligned axially parallelwise in relation to the workpiece axis, this pivotability allowing a substantially radial alignment of the pressing elements relative to the curved workpiece portion. At the end regions of the pressing elements that face towards the workpiece, the pressing elements are coated with an elastomer layer, whose surface facing towards the workpiece constitutes a pressing surface that is resilient to a limited extent and by means of which the finishing belt is pressed onto the workpiece surface.

The swinging mounting of the pressing elements has the effect that, upon the pressing surfaces being applied to the back side of the finishing belt tensioned over the workpiece portion, the pressing elements align themselves substantially radially relative to this workpiece portion, such that the pressing surfaces bear substantially flatly on the back side of the finishing belt. The greater the diameter of the workpiece portion in this case, the smaller the relative angle of inclination between the pressing elements becomes. The pivotablity of the pressing elements allows adaptation to greatly differing workpiece portion diameters, the elasticity in the region of the pressing surfaces having the effect, at the same time, that a full-surface contact between the pressing element and the finishing belt is present in each case, even in the case of differing curvatures of the workpiece surface. For the transfer of the pressing forces, this arrangement is relatively rigid, such that, with this variant, relatively great surface pressures, and consequently a high material removal rate, can be achieved in the region of the pressing elements. Clearly, more than three pressing elements can also be provided, for example 5, 7 and 9 pressing elements or more. In this case, the arrangement density of the pressing elements has to make allowance only for sufficient clearance remaining for the mutual pivoting of the pressing elements in the diameter range intended for the pressing device. In the region of the pressing surfaces, the pressing elements, accommodated in a swinging manner, can be pre-ground to a mean diameter of the envisaged diameter range, such that, starting from this mean curvature, only slight surface-shape adaptations are required upon being pressed on.

Figure 9:
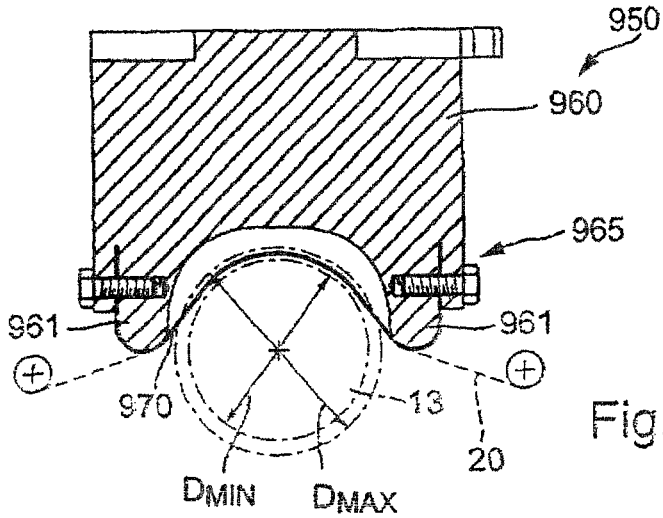
FIG. 9 shows an embodiment of a pressing device having a pressing band for a finishing belt.

FIG. 9 shows a largely true-to-scale representation of a pressing device 950 for a finishing belt 20, which device is steplessly adaptable for the purpose of machining workpiece portions of diameters from a diameter range between $D_{MIN}$=50 mm and $D_{MAX}$=58 mm, being so adaptable substantially in the manner described in connection with FIG. 2. A carrier element 960 made of tool steel has, on its side that faces towards the workpiece portion 13, a C-shaped recess that is bounded on both sides by supporting portions 961 having a semi-cylindrical outer contour. On the outsides of the supporting portions that face away from one another there are clamping devices 965, for fixing the ends of a pressing band 970 to the carrier element 860 by clamping. For this purpose, the clamping devices each have a receiving slot for the respectively assigned end of the pressing band 970, and have a clamping screw, by means of which the inserted pressing band can be fixedly clamped in the receiving slot. When in the clamped-in state, the pressing band is guided into the inside of the recess by the semi-cylindrically curved supporting portions, serving as bearing points, in such a way that there is realized on the non-loaded pressing band a curvature that is directed into the inside of the carrier element, the front side of the pressing band, which is curved in the form of a concave cylinder, serving as a pressing surface for the finishing belt 20. The pressing band 970 is a spring steel band of a material thickness of approximately 0.3 mm. The dot-dash circles on the workpiece portion 13 represent, in a true-to-scale manner, the minimum diameter 50 mm and the maximum diameter 58 mm of workpiece portions that can be machined by means of this pressing device.

Figure 10:
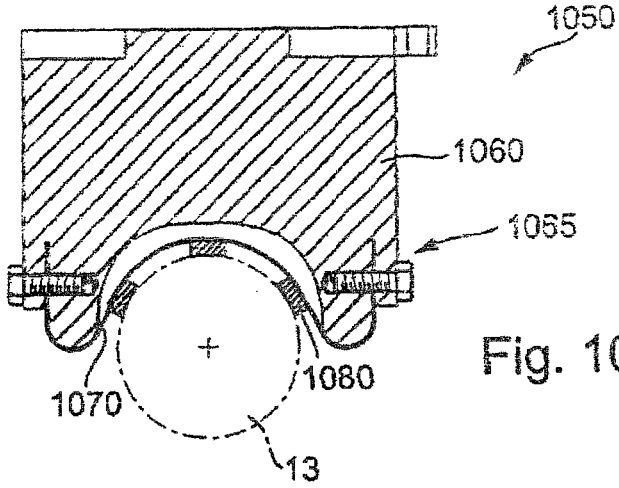
FIG. 10 shows an embodiment of a pressing device having a spring-steel pressing band, which carries three relatively wide finishing stones on its front side.
Figure 11:
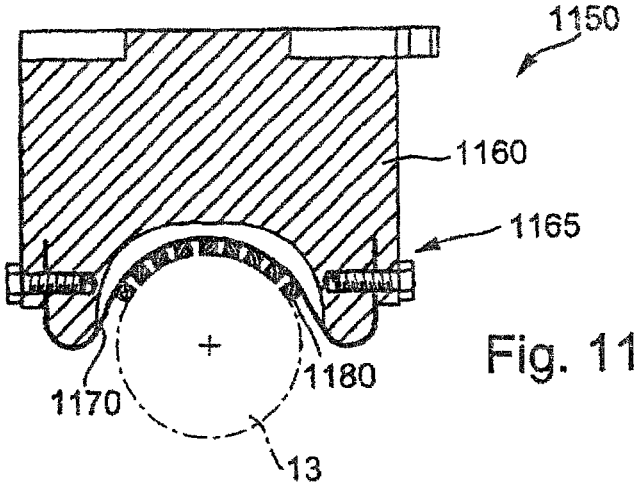
FIG. 11 shows an embodiment of a pressing device having a pressing band, which carries a multiplicity of narrow finishing stones on its front side.

The pressing devices shown in FIGS. 10 and 11 are intended for finishing apparatuses that do not work with a finishing belt, but with grinding bodies (so-termed finishing stones), whose front faces, provided with cutting means, are pressed directly onto the workpiece surface to be machined. The carrier element 1060 of the pressing device 1050 in FIG. 10 has the same structure as the carrier element 960 from FIG. 9. In addition, the clamping devices 1065 for clamping in the ends of the pressing band 1070 have the same structure. The pressing band is a spring steel band of a material thickness of approximately 0.3 mm, and it carries, on its front side that faces towards the workpiece portion 13, three cutting-material bodies, in the form of diamond strips 1080, which are arranged with a mutual spacing and whose length in the transverse direction of the pressing band corresponds substantially to the width of the pressing band in the transverse direction. The width of the diamond strips (measured in the longitudinal direction of the driving belt) is in each case so dimensioned that the contact angle in the circumferential direction of a single diamond strip lies in the range between approximately 10° and approximately 20°, for example at 15°. The front surfaces facing towards the workpiece are each provided with a concavely cylindrical profiling, such that each of the diamond strips bears on the workpiece surface over a large area, via their entire width. The mutual spacing of the diamond strips is greater than the width of the diamond strips in the band direction and can be, for example, between 120% and 200% of this width. In total, the three cutting-material bodies 1070 cover a contact angle of approximately 135°. Frequently, the total contact angle is between 90° and 150°. Owing to the elastic flexibility of the pressing band, the pressing device is able to adapt to workpiece portions of differing diameter, but it must be ensured that, for a given profiling of the abrasive front sides of the cutting-material bodies, a relatively large-area working contact occurs in the case of all diameters of the diameter range. Owing to the large gaps between the individual cutting-material bodies, the supplying of cooling lubricant and the removal of stock can be very efficient, such that, even in the case of high pressing forces and a correspondingly large removal of material, trouble-free machining is ensured.

In the case of the pressing device 1150 represented in FIG. 11, the carrier element 1160 and the clamping devices 1165 are identical to the embodiments of FIGS. 9 and 10. In the case of this embodiment, likewise, the spring-steel pressing band 1170 carries, on its front side that faces towards the workpiece, a plurality of cutting-material bodies 1180, which can be, for example, soldered or adhesive-bonded onto the metallic pressing band. In contrast to the embodiment of FIG. 10, however, substantially more strip-shaped cutting-material bodies are provided, namely, nine relatively narrow diamond strips, whose contact angle in the circumferential direction is significantly less than 10° in each case. Alternatively, instead of the diamond strips, for example, hard, ceramic honing stones or honing strips can also be provided. The mutual spacing between the cutting-material bodies in the band direction is less than the width of the cutting-material bodies and can be, for example, between 50% and 90% of this width. The mutual spacing should be so dimensioned that the individual cutting-material bodies do not contact one another in the region of the contact sides, even in the case of the largest possible envisaged curvature (smallest possible envisaged radius of curvature of the workpiece portion). Here, likewise, it is possible to work with high surface pressures over the entire contact range of, for example, 90° to 150°, and effective supplying of cooling lubricant and removal of stock is ensured by the channels that are realized between the strips and that extend in the transverse direction. Since the abrasive front sides of the cutting-material bodies that face towards the workpiece have only a relatively small width in the circumferential direction, however, there is no need here for profiling for the purpose of adaptation to the curvature of the outside of the workpiece. Consequently, such embodiments are particularly cost-effective in respect of their production, and they can also be used over a greater diameter range. The adaptability of the pressing device to differing workpiece diameters is realized in each case by the flexibility of the pressing band.

Figure 12:
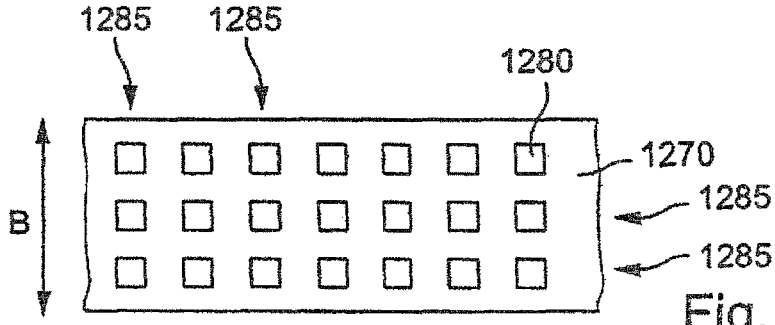
FIG. 12 shows, schematically, the front side of an elastically flexible pressing band having a two-dimensionally extended array of small cutting-means zones.

FIG. 12 shows the front side of a metallic, elastically flexible pressing band 1270 that is to be directed towards the workpiece. Arranged on the front side there is a two-dimensionally extended array of relatively small, substantially square cutting-means zones 1280, whose mean diameter, in the case of the example, is between 3 and 5 mm and is therefore substantially smaller than the width B of the pressing band transversely relative to the band direction (here approximately 25 to 30 mm). The uniformly distributed cutting-means zones (cutting-means pads) are small coating spots having galvanically bound diamond grains, which are applied to the metallic pressing band by means of a perforated mask in a coating process. In the case of other embodiments, the cutting-means zones, or pads, can also be constituted by adhesive-bonded-on soldered-on cutting-strip portions. The mutual spacing of the cutting-means zones is, for example, between 3 mm and 5 mm, such that there is formed a two-dimensionally extended array of cutting-means zones, between which channels 1285, without cutting means, extend in the longitudinal direction and in the transverse direction. The surface proportion of the channels is of an order of magnitude similar to the surface proportion of the cutting-means zones, such that a reliable supplying of coolant and removal of stock are ensured. The array of cutting-means zones can be provided, for example, instead of the cutting bodies 1080 or 1180 in the case of the exemplary embodiments in FIG. 10 or FIG. 11.

The invention claimed is:

1. An apparatus for finishing circumferential surfaces of substantially cylindrical workpiece portions on workpieces, wherein the apparatus is configured as a belt finishing machine and comprises:

a cutting means provided on a finishing belt;

at least one pressing device for pressing the finishing belt and cutting means onto the circumferential surface of a workpiece;

a rotary device for generating a rotary motion of the workpiece about a workpiece axis; and an oscillation device for generating an oscillating relative motion, aligned parallelwise in relation to the workpiece axis, between the workpiece and the at least one pressing device in such a way that the cutting means is pressed onto the circumferential surface with a pressing force over a contact angle;

wherein the pressing device is steplessly adaptable for the machining of workpiece portions of differing diameters that have a diameter difference of at least 0.1 mm, wherein the pressing device comprises at least one elastically flexible pressing band, which is substantially inelastic in a band direction, the pressing band being fastened to two bearings of a carrier element that are arranged at a distance from one another, and wherein the pressing device comprises anti-slip means configured to impede slippage of the finishing belt relative to the pressing band when the pressing device presses the finishing belt onto the circumferential surface of the workpiece, the anti-slip means being provided on a front side of the pressing band facing the workpiece.

2. The apparatus as claimed in claim 1, wherein the diameter difference is at least 1%.

3. The apparatus as claimed in claim 1, wherein the pressing device is designed in such a way that each diameter can be machined in a diameter range having a diameter difference of at least 0.1 mm between a minimum and a maximum diameter in the case of a mean diameter between 20 mm and 70 mm.

4. The apparatus as claimed in claim 1, wherein the pressing device is so designed that the stepless adaptation is effected in a self-acting manner, as a result of the design of the pressing device, upon the pressing device being pressed onto the workpiece portion.

5. The apparatus as claimed in claim 1, wherein the pressing band is constructed in accordance with at least one of the following conditions:

(i) the pressing band comprises at least one metal band composed of a resilient metal;

(ii) the pressing band comprising at least one metal band composed of spring steel;

(iii) the pressing band is constituted exclusively by a metal band; and (iv) the pressing band is composed of an elastomer material that is reinforced by inelastic fibers extending a band direction.

6. The apparatus as claimed in claim 1, wherein the bearings on the carrier element are arranged at a fixed distance in relation to one another.

7. The apparatus as claimed in claim 1, wherein the apparatus is configured as a belt finishing machine;

the cutting means are provided on a finishing belt; and the apparatus is configured so that the finishing belt rests in the belt running direction during the machining of a workpiece portion, such that a cutting speed necessary for a removal of material is generated exclusively by the rotary motion of the workpiece and the relative oscillating motion between the workpiece and the finishing belt.

8. A pressing device for pressing cutting means onto circumferential surfaces of substantially cylindrical workpiece portions during a finishing operation in such a way that the cutting means is pressed onto a circumferential surface with a pressing force over a contact angle, comprising:

a carrier element;

two bearings arranged on the carrier element at a distance from one another;

an elastically flexible pressing band comprising a metal band which is fastened to the bearings of the carrier element and extends between the bearings in a band direction, wherein the pressing band is substantially inelastic in a band direction and has a front side to be directed towards the workpiece in operation;

wherein the front side comprises at least one of:

(i) a cutting-means layer having cutting grains bound in a binding;

(ii) a plurality of cutting bodies, mutually spaced apart from one another;

(iii) a two-dimensionally extended array of cutting-means zones, a mean diameter of which is substantially smaller than the width of the pressing band transversely relative to the band direction;

(iv) a layer of rubber-elastic material; and (v) a plurality of pressing elements composed of elastically resilient material and arranged in an offset manner in the band direction.

9. The pressing device according to claim 8, wherein flexibility of the pressing band provides that the pressing device is steplessly adaptable for the machining of workpiece portions of differing diameters that have a diameter difference of at least 0.1 mm.

10. The apparatus as claimed in claim 1, wherein fine-grain cutting material effective as anti-slip means is provided on a front side of the pressing band.

11. The apparatus as claimed in claim 1, wherein one of:

(i) a layer of rubber-elastic material, and (ii) a plurality of pressing elements composed of elastically resilient material and arranged in an offset manner in the band direction, is applied on a front side of the pressing band for the purpose of producing a limited elastic resilience of a pressing surface.

12. An apparatus for finishing circumferential surfaces of substantially cylindrical workpiece portions on workpieces, wherein the apparatus is configured as a belt finishing machine and comprises:

a cutting means provided on a finishing belt;

at least one pressing device for pressing the finishing belt and cutting means onto the circumferential surface of a workpiece;

a rotary device for generating a rotary motion of the workpiece about a workpiece axis; and an oscillation device for generating an oscillating relative motion, aligned parallelwise in relation to the workpiece axis, between the workpiece and the at least one pressing device in such a way that the cutting means is pressed onto the circumferential surface with a pressing force over a contact angle;

wherein the pressing device is steplessly adaptable for the machining of workpiece portions of differing diameters that have a diameter difference of at least 0.1 mm, wherein the pressing device comprises at least one elastically flexible pressing band, which is substantially inelastic in a band direction, the pressing band being fastened to two bearings of a carrier element that are arranged at a distance from one another, and wherein the pressing device comprises anti-slip means configured to impede slippage of the finishing belt relative to the pressing band when the pressing device presses the finishing belt onto the circumferential surface of the workpiece.

13. The apparatus as claimed in claim 12, wherein the carrier element comprises, on a side that faces towards the work piece portion, a C-shaped recess that is bound on both sides by supporting portions having a semi-cylindrical outer contour, and further comprises:

clamping devices on outsides of the supporting portions facing away from one another, the clamping devices being configured to fix ends of the pressing band to the carrier element by clamping.

* * * * *